US010001098B2

(12) United States Patent
Ando et al.

(10) Patent No.: US 10,001,098 B2
(45) Date of Patent: Jun. 19, 2018

(54) FUEL PUMP

(71) Applicant: TOYOTA JIDOSHA KABUSHIKI KAISHA, Toyota-shi, Aichi-ken (JP)

(72) Inventors: Hiroya Ando, Okazaki (JP); Kazuhiro Asayama, Nagoya (JP); Yoshinori Ogaki, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 172 days.

(21) Appl. No.: 14/874,833

(22) Filed: Oct. 5, 2015

(65) Prior Publication Data

US 2016/0245248 A1 Aug. 25, 2016

(30) Foreign Application Priority Data

Feb. 20, 2015 (JP) ..... 2015-032302

(51) Int. Cl.

| | |
|---|---|
| ***F04B 1/04*** | (2006.01) |
| ***F02M 59/10*** | (2006.01) |
| ***F04B 7/00*** | (2006.01) |
| ***F04B 53/14*** | (2006.01) |
| ***F04B 9/04*** | (2006.01) |

(52) U.S. Cl.

CPC ..... *F02M 59/102* (2013.01); *F04B 1/0408* (2013.01); *F04B 1/0413* (2013.01); *F04B 1/0426* (2013.01); *F04B 1/0439* (2013.01); *F04B 7/0057* (2013.01); *F04B 9/042* (2013.01); *F04B 53/14* (2013.01)

(58) Field of Classification Search

CPC .... F04B 1/0426; F04B 1/0439; F04B 53/147; F02M 29/02; F02M 29/10; F02M 29/102

USPC ..... 417/415

See application file for complete search history.

(56) References Cited

U.S. PATENT DOCUMENTS

| | | | | |
|---|---|---|---|---|
| 2,322,356 A * | 6/1943 | Hahn | ..... | F02M 59/48 417/494 |
| 8,820,300 B2 * | 9/2014 | Aritomi | ..... | F02M 59/102 123/495 |
| 2005/0100466 A1 * | 5/2005 | Aoki | ..... | F02M 59/102 417/533 |

FOREIGN PATENT DOCUMENTS

JP 2009-209838 A 9/2009

* cited by examiner

*Primary Examiner* — Peter J Bertheaud

(74) *Attorney, Agent, or Firm* — Oliff PLC

(57) ABSTRACT

A fuel pump includes a holed disk-shaped plate and a coil spring to press the plate toward a lifter. The plate has an inner circumferential surface to be engaged with a groove in a projection-side end portion of a plunger. Also, a joint port that connects the inner peripheral surface of the plate to an outer peripheral surface thereof is provided in the plate. The coil spring is located between the plate and a pump body. The plate is assembled in the fuel pump to dispose the joint port at a position in an opposite direction to the direction of a side force to be generated during compression of the coil spring when viewed from a central axis of the coil spring.

6 Claims, 10 Drawing Sheets

FUEL PUMP

BACKGROUND OF THE INVENTION

The present invention relates to a fuel pump.

Japanese Laid-Open Patent Publication No. 2009-209838 discloses a fuel pump that pressurizes and discharges a fuel pumped up by a feed pump from a fuel tank. The fuel pump disclosed in this document includes a pump housing having a cylinder and a columnar plunger located inside the cylinder. One end portion of the plunger is inserted in an interior of the cylinder, and the other end portion projects externally from the cylinder. In this state, the plunger is located to slide in a reciprocating manner along its central axis. On the end portion of the plunger projecting externally from the cylinder, a groove extending circumferentially along an outer peripheral surface of the plunger is formed. A holed disk-shaped plate is engaged with the groove of the plunger. A cam reciprocating the plunger in the interior of the cylinder is located under the fuel pump. A lifter is located between the cam and the end portion of the plunger projecting externally from the cylinder. Between a lower portion of the fuel pump and the plate, a coil spring to press the plate against an upper surface of the lifter is located.

FIG. 17A shows an example of a coil spring to be installed in the fuel pump described above. As shown in FIG. 17A, in the vicinity of end portions of the coil spring, the coil spring has a smaller winding interval toward the terminal end of the winding. In the coil spring described above, elasticity against compression varies depending on the position around a central axis L of the coil spring. For example, the modulus of longitudinal elasticity in a left-hand part X where the winding interval is relatively wide in the vicinity of the end portions is smaller than that of a right-hand part Y where the winding interval is relatively narrow. Therefore, as shown in FIG. 17B, when a compressive force Fc is applied to the coil spring, the coil spring contracts further in the part X than in the part Y. Therefore, the coil spring curves in a manner such that a central part bulges to the right. As a result, rightward acting side force Fs is generated in the coil spring.

In the above-described conventional fuel pump, when such a side force as above is generated in the coil spring, the side force is transmitted to the plunger via the plate. At this time, a moment acts on the plunger in a direction inclined with respect to the cylinder. When the plunger inclines due to the moment, friction that occurs on a sliding surface between the plunger and cylinder locally increases, causing possible abnormalities in wear or heat generation in the plunger or cylinder.

SUMMARY OF THE INVENTION

In order to solve the above-described problems, according to a first aspect of the present invention, in the plate, a joint port that connects an outer peripheral surface of the plate to the inner circumferential surface of the plate is provided at a generally aligned with the counter-side force when viewed along the central axis of the coil spring, or a radial gap between the inner circumferential surface of the plate and the groove is larger at a location generally aligned with the counter-side force than at other locations when a central axis of the plate and a central axis of the plunger are coincident.

DETAILED DESCRIPTION OF THE PREFERRED EMBODIMENTS (First Embodiment)

Hereinafter, a first embodiment of a fuel pump of the present invention will be described in detail with reference to FIG. 1 to FIG. 13. The fuel pump is a pump that pressurizes a fuel pumped up by a feed pump from a fuel tank and discharges the fuel to a delivery pipe, and is used as a high-pressure fuel pump of a direct-injection internal combustion engine. In the following description, the up-down direction will be defined as shown in FIG. 1 and FIG. 2.

Figure 1:
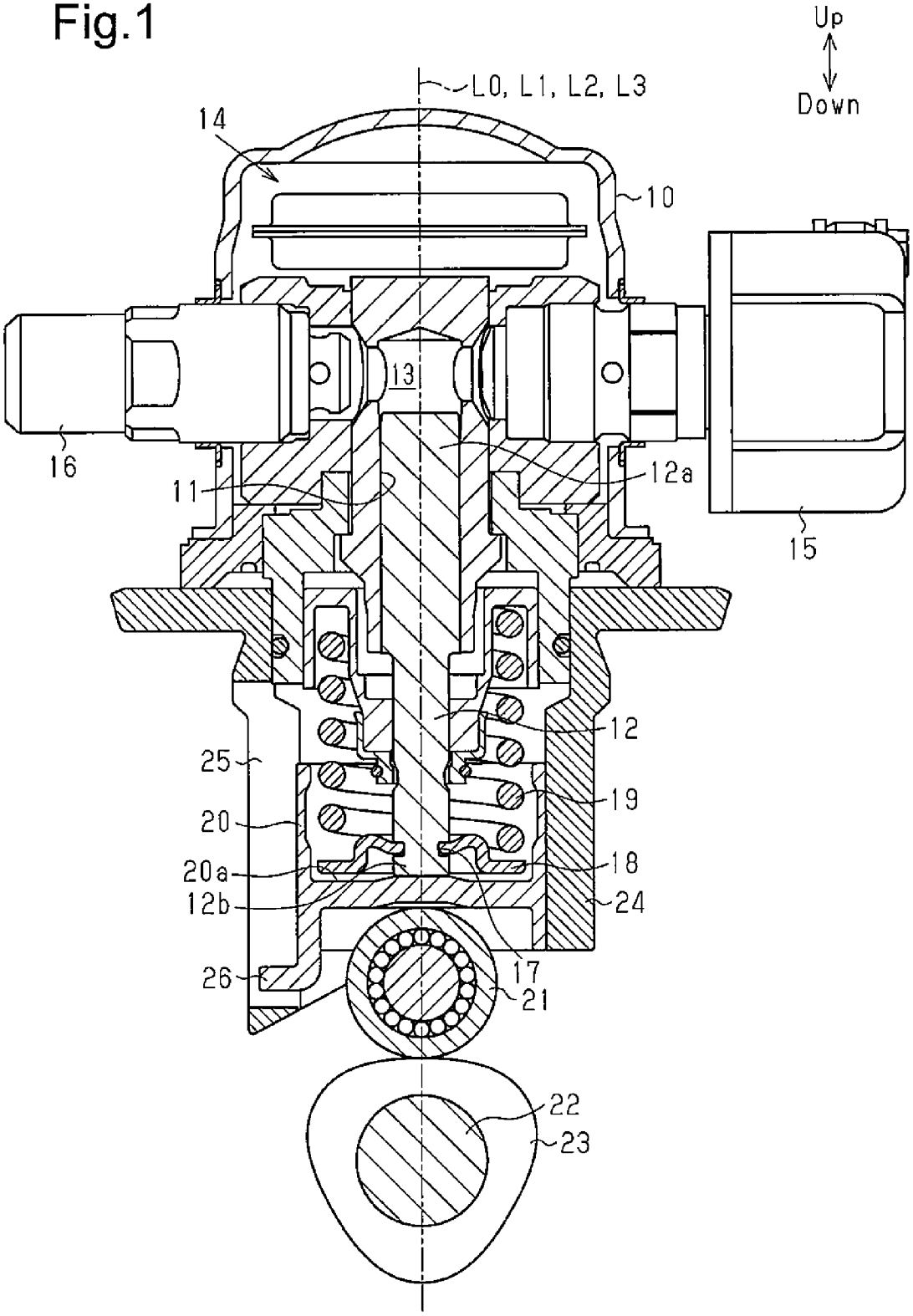
FIG. 1 is a sectional view of a fuel pump according to a first embodiment of the present invention.
Figure 2:
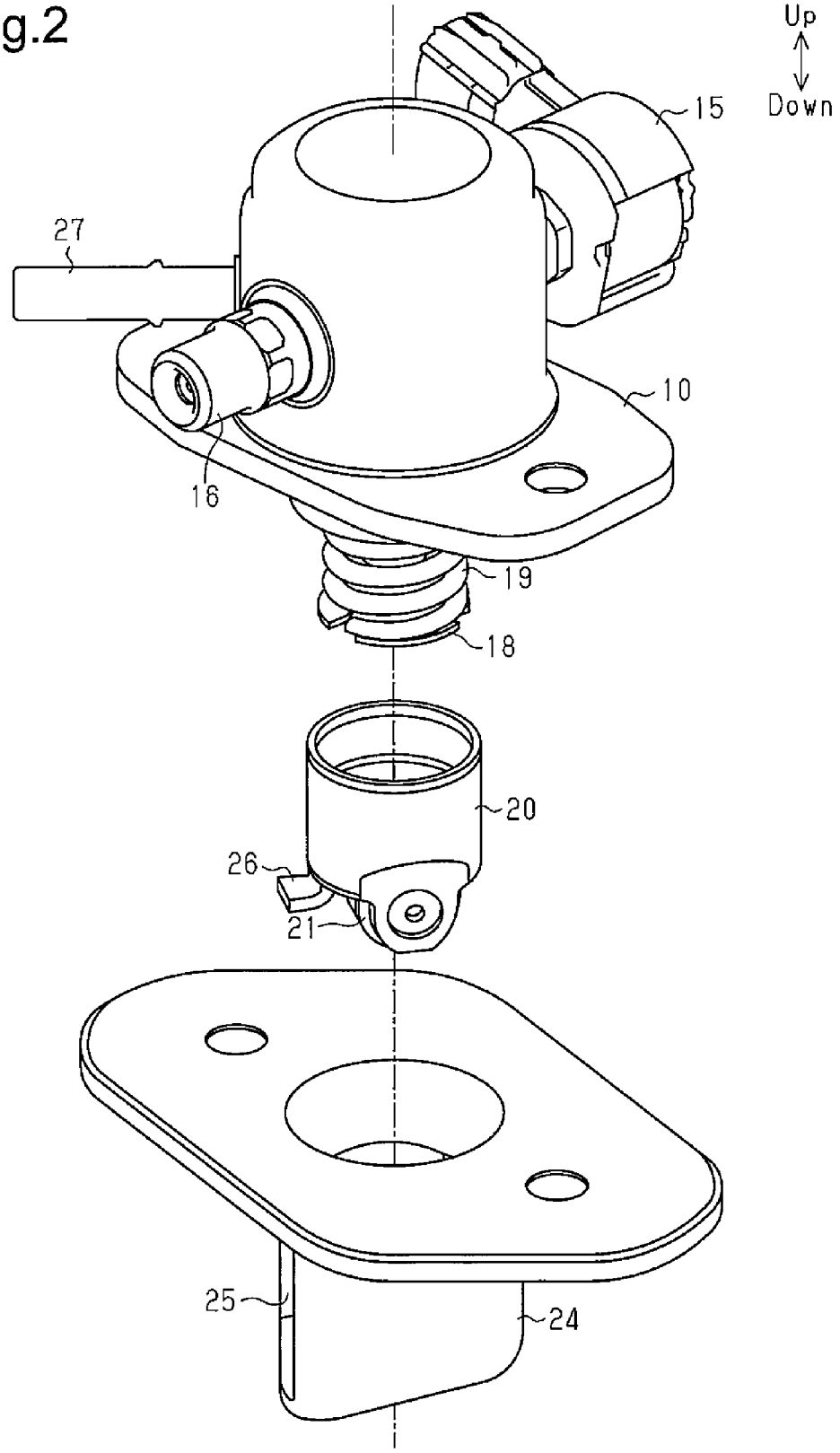
FIG. 2 is an exploded perspective view of the fuel pump.

As shown in FIG. 1, the fuel pump includes a pump body 10 to be attached to a cylinder head cover of a direct-injection internal combustion engine. In the pump body 10, a cylinder 11 extending in the up-down direction is provided. The cylinder 11 is opened downward.

A substantially columnar plunger 12 is located in an interior of the cylinder 11. One end portion of the plunger 12 is inserted in the interior of the cylinder 11, and the other end portion projects externally from the cylinder 11. In this state, the plunger 12 is located to slide in a reciprocating manner along a central axis L0. A pressure chamber 13 for pressurizing fuel is formed in the interior of the cylinder 11. The pressure chamber 13 is defined by a bottom portion of the cylinder 11 and an end surface of one end portion of the plunger 12 inserted in the cylinder 11. In the following, one end portion of the plunger 12 inserted in the interior of the cylinder 11 will be described as an insertion-side end portion 12*a*, and the other end portion of the plunger 12 projecting externally from the cylinder 11 will be described as a projection-side end portion 12*b*.

A fuel chamber 14 is provided in an interior of the pump body 10. The fuel chamber 14 is connected with a low-pressure fuel piping that leads to a feed pump installed in the direct-injection internal combustion engine. A fuel pumped by the feed pump from a fuel tank is introduced into the fuel chamber 14.

A solenoid inlet valve 15 is attached to the pump body 10. The fuel chamber 14 is connected to the pressure chamber 13 via the solenoid inlet valve 15. When the solenoid inlet valve 15 is energized, the solenoid inlet valve 15 is closed to shut off circulation of fuel between the fuel chamber 14 and the pressure chamber 13. On the other hand, when the energization of the solenoid inlet valve 15 is stopped, the solenoid inlet valve 15 opens to allow the circulation of fuel between the fuel chamber 14 and the pressure chamber 13.

Further, a check valve 16 is attached to the pump body 10. The pressure chamber 13 of the pump body 10 is also connected to the check valve 16. The check valve 16 is an always-closed differential pressure regulating valve. Therefore, the check valve 16 opens when the pressure of fuel within the pressure chamber 13 is a predetermined valve opening pressure or more. The check valve 16 is connected with a high-pressure fuel piping that leads to a delivery pipe installed in the direct-injection internal combustion engine. When the check valve 16 opens, the fuel within the pressure chamber 13 is discharged to the delivery pipe.

A groove 17 extending circumferentially along an outer peripheral surface of the plunger 12 is formed in the projection-side end portion 12*b* of the plunger 12. An annular disk-shaped plate 18 is attached to the projection-side end portion 12*b* of the plunger 12. The plate 18 is attached to the projection-side end portion 12*b* of the plunger 12 by engagement between an inner peripheral surface of the central opening of the disk-shaped plate 18 and the groove 17. A coil spring 19 is located in a compressed state between the plate 18 and the pump body 10. Therefore, the plate 18 is pressed downward by the coil spring 19. The plate 18 is in contact with a lower end of the coil spring 19 such that a central axis L2 of the disk-shaped plate 18 is coincident with a central axis L1 of the coil spring 19.

Also, the fuel pump has a lifter 20 around the projection-side end portion 12*b* of the plunger 12. The lifter 20 has a cylindrical shape with a bottom and has an opened upward end. The lifter 20 is located to surround the projection-side end portion 12*b* attached to the plate 18. The lifter 20 has an inner bottom surface 20*a*, which is brought into contact with an end surface of the projection-side end portion 12*b* of the plunger 12. A roller 21 is rotationally supported on a lower portion of the lifter 20. The roller 21 is in contact with a cam 23 for pump driving that rotates with a cam shaft 22 of the direct-injection internal combustion engine. The lifter 20 is located between the end surface of the projection-side end portion 12*b* of the plunger 12 and the cam 23. The roller 21 is pressed against the cam 23 by a biasing force of the coil spring 19 transmitted via the plate 18 and the plunger 12.

As shown in FIG. 2, a lifter guide 24, which has a cylindrical shape, is provided on a lower portion of the pump body 10. The lifter guide 24 extends along a central axis L0 of the plunger 12. The lifter guide 24 is located to surround the plunger 12, the plate 18, and the coil spring 19 from the outside. The lifter 20 is installed within the lifter guide 24 such that its outer peripheral surface is brought into sliding contact with an inner peripheral surface of the lifter guide 24. A guide groove 25 extending along the central axis L0 of the plunger 12 is provided in the lifter guide 24. The lifter 20 has a protrusion 26, which is inserted into the guide groove 25. The protrusion 26 projects radially outward from the outer peripheral surface of the lifter 20. By the protrusion 26 engaging with the guide groove 25, the lifter 20 is restricted from rotating about the central axis L0 with respect to the pump body 10.

The pump body 10 has a connector 27 projecting from a side surface of the pump body 10. The connector 27 is connected with a low-pressure fuel piping installed in the direct-injection internal combustion engine.

In the fuel pump described above, when the direct-injection internal combustion engine is brought into operation to rotate the cam shaft 22, the lifter 20 moves in the up-down direction according to a profile shape of the cam 23. The plunger 12 thereby remains pressing the end surface of the projection-side end portion 12*b* against the bottom surface of the lifter 20 by the coil spring 19 while sliding in the interior of the cylinder 11 in a reciprocating manner.

The pressure chamber 13 has a smaller capacity as the plunger 12 rises to approach the pressure chamber 13. On the other hand, the pressure chamber 13 has a larger capacity as the plunger 12 falls to approach the cam 23. Therefore, when the plunger 12 falls with the solenoid inlet valve 15 open, the fuel within the fuel chamber 14 is introduced into the pressure chamber 13 in response to an increase in capacity of the pressure chamber 13. When the plunger 12 rises with the solenoid inlet valve 15 open, the fuel introduced into the pressure chamber 13 is returned to the fuel chamber 14 in response to a reduction in capacity of the pressure chamber 13.

When the solenoid inlet valve 15 is closed during the rise of the plunger 12, because the pressure chamber 13 is hermetically sealed, the pressure chamber 13 is reduced in capacity, and the fuel within the pressure chamber 13 is pressurized. Then, when the pressure of fuel within the pressure chamber 13 has reached a valve opening pressure of the check valve 16, the check valve 16 opens, and the pressurized fuel within the pressure chamber 13 is discharged. As a result of the intake and discharge of fuel being thus repeated, the pressurized fuel is fed out to the delivery pipe from the fuel pump. Also, by changing the valve opening period of the solenoid inlet valve 15 during a rise of the plunger 12, that is, the energization period of the solenoid inlet valve 15, the fuel to be fed out to the delivery pipe from the fuel pump is adjusted in the amount of feeding under pressure.

Figure 3:
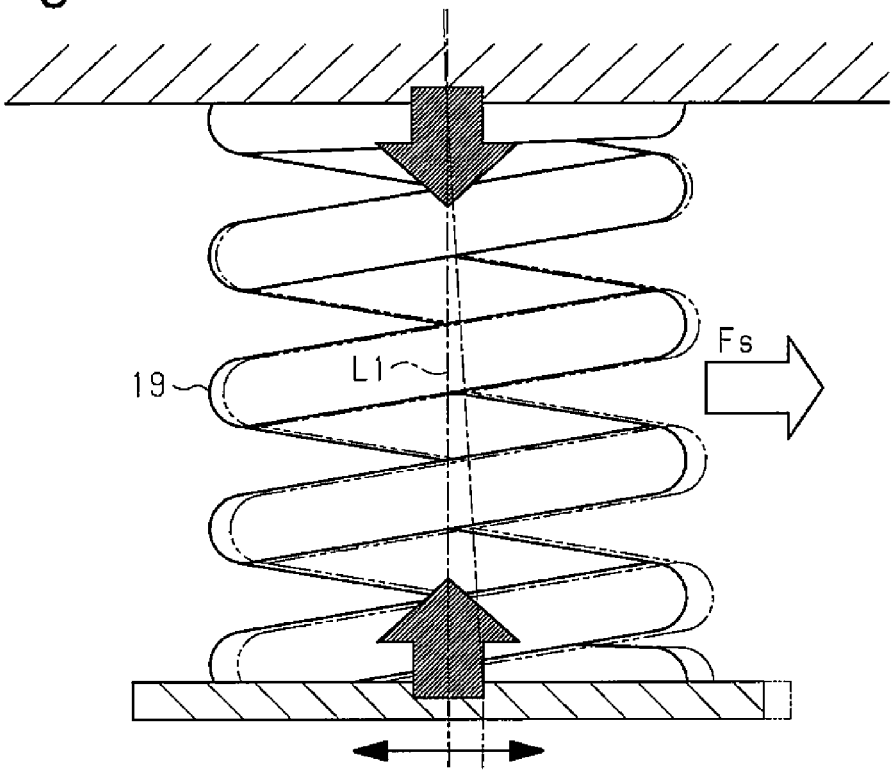
FIG. 3 is a schematic view describing a method for confirming the direction of a side force to be generated in a coil spring of the fuel pump.
Figure 4:
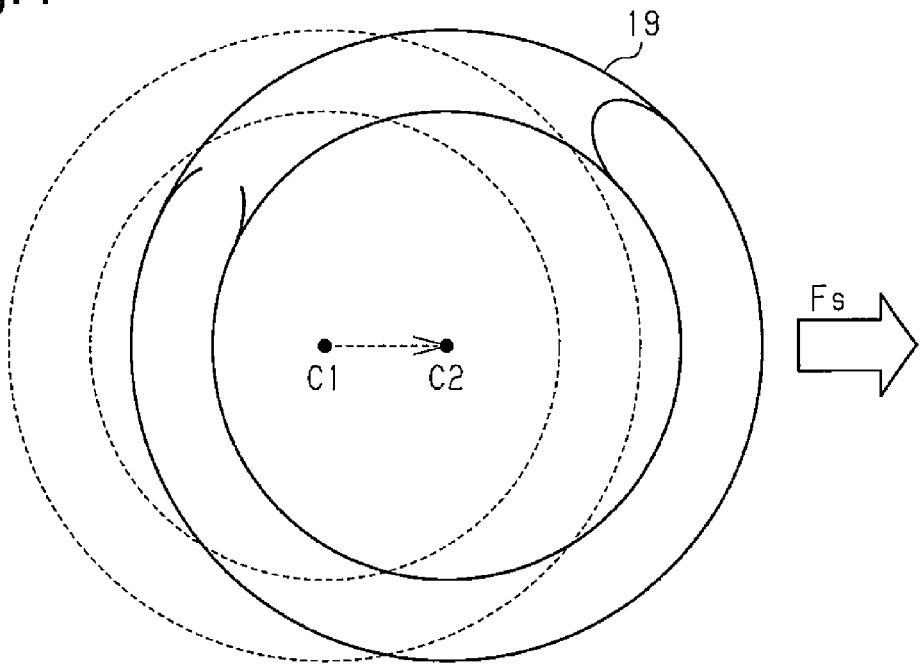
FIG. 4 is a plan view of the coil spring describing the method for confirming the direction of a side force.

As shown in FIG. 3, in the fuel pump described above, a side force Fs is generated in the coil spring 19 compressed by a rise of the plunger 12. The side force Fs acts in a direction perpendicular to a sliding direction of the plunger 12. The direction of the side force Fs generated in the coil spring 19 can be confirmed in the following manner. First, as shown in FIG. 3, the coil spring 19 is compressed with one end portion of the coil spring 19 fixed to a fixed object and the other end portion supported movably in a radial direction of the coil spring 19. When the coil spring 19 is compressed as described above, as shown in FIG. 4, a center position C2 of the other end portion of the coil spring 19 is, due to the side force Fs generated due to the compression, shifted in a radial direction of the coil spring 19 from a central position C1 of one end portion. The direction of shifting of the center position C2 with respect to the center position C1 at this time corresponds to the direction of the side force Fs generated during compression of the coil spring 19. The direction of the side force Fs can thus be confirmed by observing the direction of shifting of the center positions C1 and C2 at both ends of the coil spring 19. If coil springs 19 have identical specifications, the direction of the side force Fs is the same. Therefore, it suffices to confirm the direction of the side force Fs generated in the coil spring 19 by the type or production lot of the coil spring 19.

Figure 5:
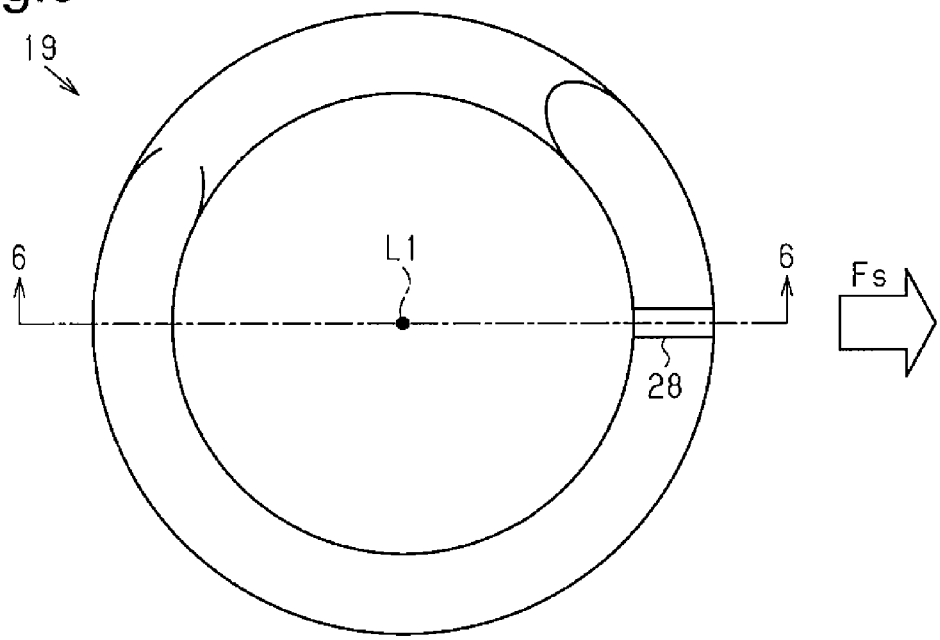
FIG. 5 is a bottom view of the coil spring.
Figure 6:
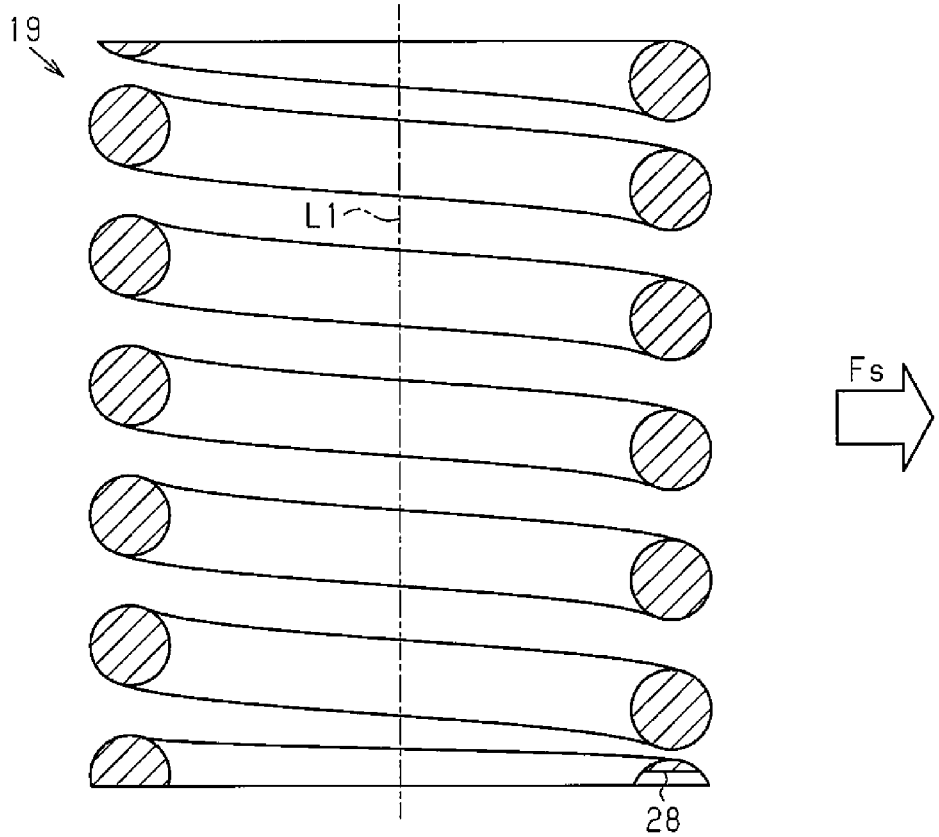
FIG. 6 is a sectional view taken along a line 6-6 of FIG. 5.

As shown in FIG. 5 and FIG. 6, a recess portion 28 is formed in a lower end surface of the coil spring 19 that is brought into contact with the plate 18. The recess portion 28 is formed, when viewed along the central axis L1 of the coil spring 19, at a position aligned with the side force Fs generated during compression of the coil spring 19.

Figure 7:
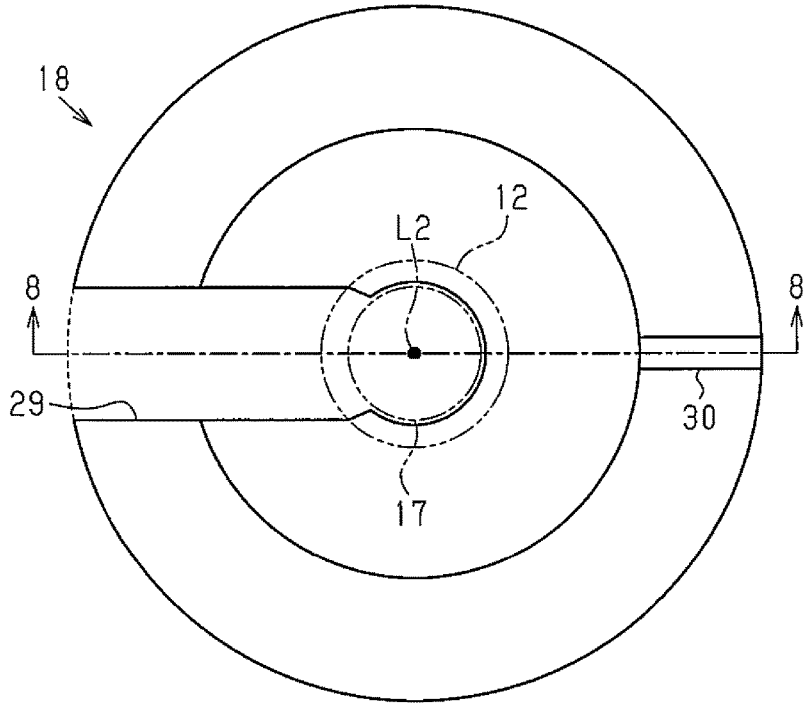
FIG. 7 is a bottom view of a plate of the fuel pump.
Figure 8:
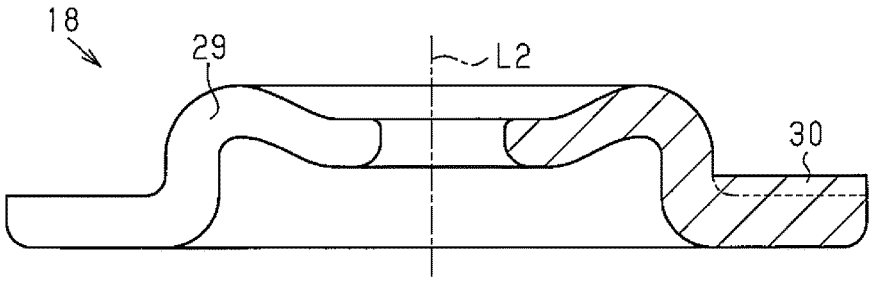
FIG. 8 is a sectional view taken along a line 8-8 of FIG. 7.

As shown in FIG. 7 and FIG. 8, a joint port 29 is formed in the plate 18, and the joint port 29 connects an outer peripheral surface of the plate 18 and an inner peripheral surface of the central hole of the plate 18. The joint port 29 is a cut-away for permitting the plunger 12 to be fitted to the inner peripheral surface of the hole of the plate 18 when engaging the plate 18 with the groove 17 of the plunger 12. The width of the joint port 29 is substantially the same as the diameter of a part to be engaged with the groove 17 of the plunger 12. Also, the plate 18 has a projection portion 30 at a front surface to be brought into contact with the coil spring 19. The projection portion 30 projects upward from a part near an outer peripheral edge of the plate 18. The projection portion 30 has a width along a circumferential direction of the plate 18. The recess portion 28 has a width along a circumferential direction of the coil spring 19. The width of the projection portion 30 is slightly smaller than the width of the recess portion 28. Therefore, the projection portion 30 is engageable with the recess portion 28. The projection portion 30 is formed, when viewed along the central axis L2 of the plate 18, at a position opposite to the joint port 29.

Figure 9:
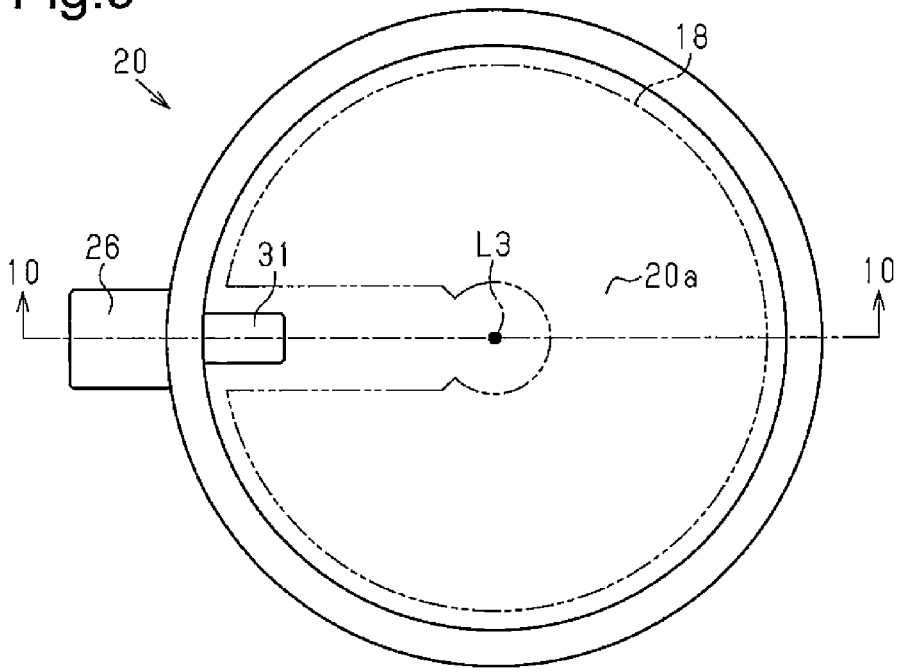
FIG. 9 is a top view of a lifter of the fuel pump.
Figure 10:
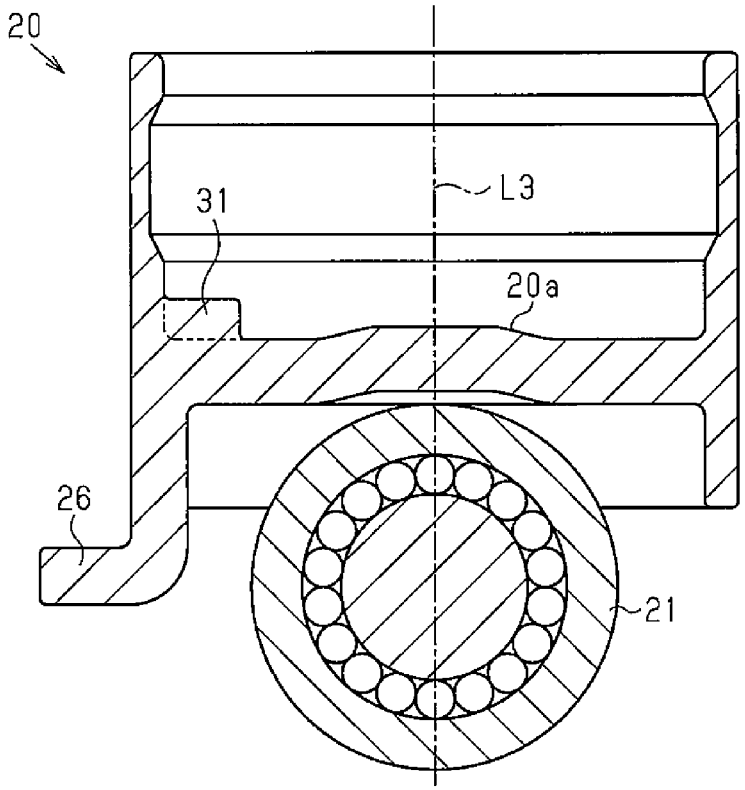
FIG. 10 is a sectional view taken along a line 10-10 of FIG. 9.

As shown in FIG. 9 and FIG. 10, a projection portion 31 is provided on the inner bottom surface 20*a* of the lifter 20. The projection portion 31 projects upward from a part near an outer peripheral edge of the lifter 20. The projection portion 31 has a width along a circumferential direction of the lifter 20. The width of the projection portion 31 is slightly smaller than the width of the joint port 29. Therefore, the projection portion 31 is engageable with the joint port 29. In a state where the lifter 20 is assembled in the fuel pump, the projection portion 31 is provided, when viewed from a central axis L3 of the lifter 20, at a position in the same direction as the joint port 29 of the plate 18.

Figure 11:
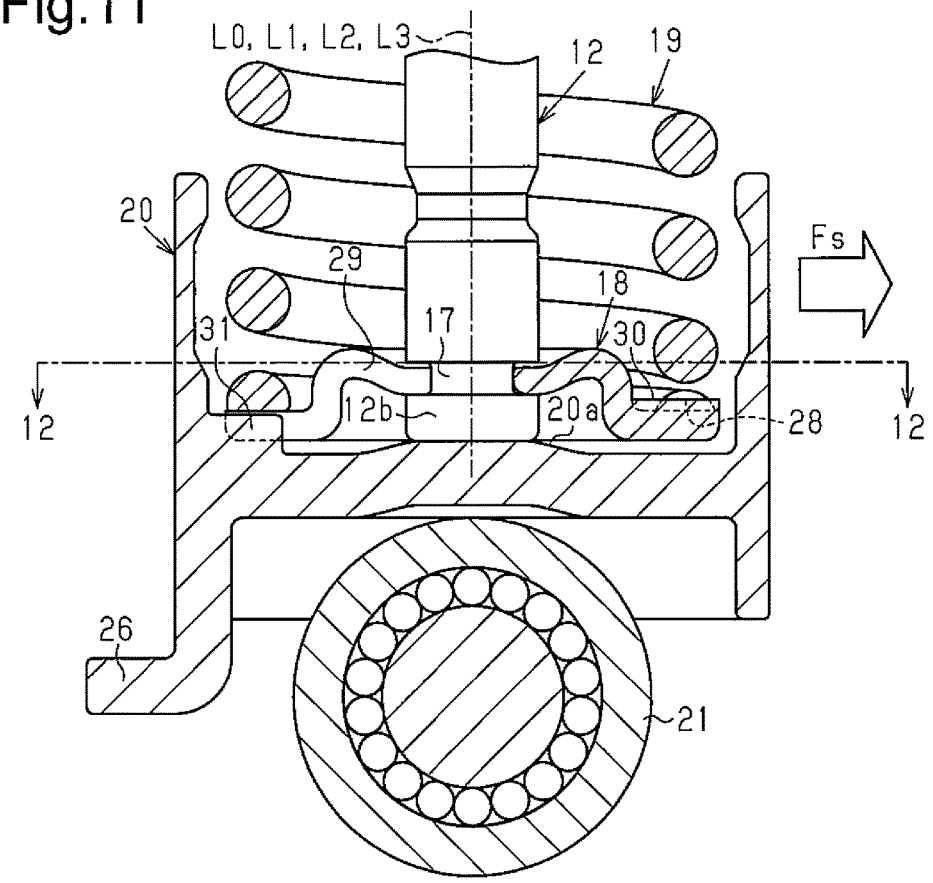
FIG. 11 is a partial sectional view showing a periphery of the lifter of the fuel pump in an enlarged manner.

As shown in FIG. 11, the coil spring 19, the plate 18, and the lifter 20 are respectively assembled in the fuel pump. In this state, the projection portion 30 of the plate 18 is engaged with the recess portion 28 of the coil spring 19, and the projection portion 31 of the lifter 20 is engaged with the joint port 29 of the plate 18. That is, as a result of the projection portion 30 of the plate 18 engaging with the recess portion 28 of the coil spring 19, the plate 18 and the coil spring 19 are assembled in a state of being restricted from relatively rotating about their central axes L1 and L2. Also, as a result of the projection portion 31 of the lifter 20 engaging with the joint port 29 of the plate 18, the plate 18 and the lifter 20 are assembled in a state of being restricted from relatively rotating about their central axes L2 and L3.

Figure 12:
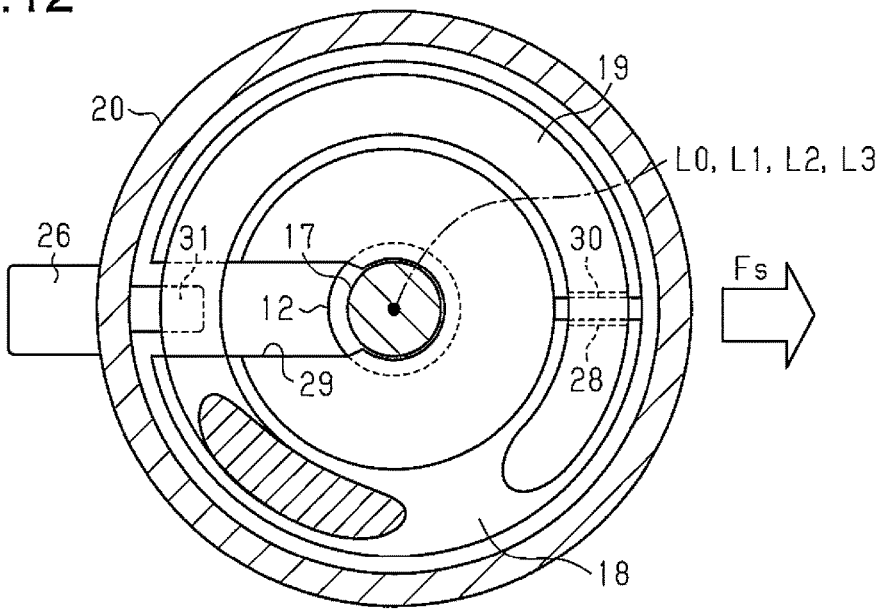
FIG. 12 is a sectional view taken along a line 12-12 of FIG. 11.

As in the foregoing, the recess portion 28 of the coil spring 19 is located at a position in the direction of a side force Fs when viewed from the central axis L1 of the coil spring 19. Also, the projection portion 30 of the plate 18 is located at a position in the direction opposite to the joint port 29 when viewed from the central axis L2 of the plate 18. Therefore, as shown in FIG. 12, the plate 18 is assembled with the joint port 29 located, when viewed from the central axis L1 of the coil spring 19, at a position in an opposite direction to the direction of a side force Fs (counter-side force direction).

Subsequently, actions of the fuel pump described above will be described with reference to FIG. 13.

Figure 13:
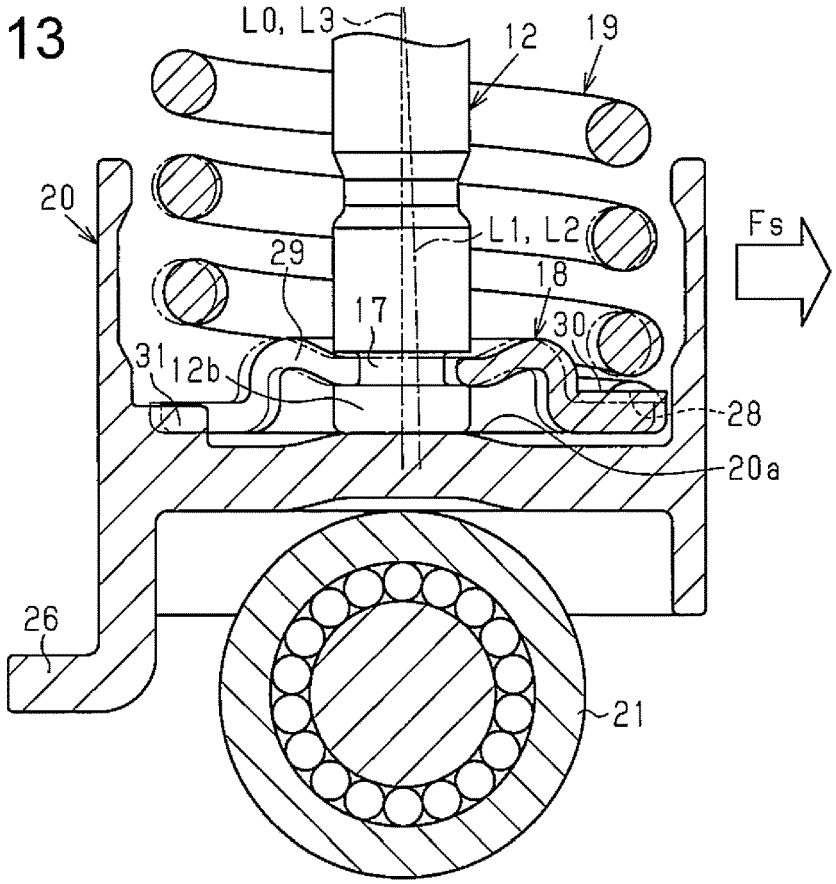
FIG. 13 is a partial sectional view showing the periphery of the lifter when a side force of the fuel pump is generated.

As shown in FIG. 13, when the coil spring 19 is compressed by a rise of the plunger 12, a side force Fs is generated in the coil spring 19. The side force Fs is first transmitted to the plate 18 that is in contact with the coil spring 19. At this time, because the plate 18 has the joint port 29 at a position in the counter-side force direction, a movement in the direction of the side force Fs of the plate 18 with respect to the plunger 12 is allowed. Therefore, transmission of the side force Fs from the plate 18 to the plunger 12 is suppressed.

Also, because increasing a gap between the groove 17 of the plunger 12 and the entire inner peripheral surface of the hole of the plate 18 also allows a movement in the direction of the side force Fs of the plate 18 with respect to the plunger 12, transmission of the side force Fs from the plate 18 to the plunger 12 is suppressed. However, in this case, there is a possibility of increasing rattling of the plate 18 to cause collision of the plate 18 with the plunger 12 and the lifter 20 during operation of the fuel pump, generating noise. Regarding that point, in the present embodiment, the position of the joint port 29 for attaching the plate 18 to the plunger 12 is set according to the position in the direction of a side force Fs. Because transmission of the side force Fs to the plunger 12 is thereby suppressed, an increase in rattling of the plate 18 does not occur.

As above, the fuel pump described above can provide the following effects.

(1) The plate 18 is assembled with the joint port 29 located at a position in an opposite direction to the direction of a side force Fs to be generated during compression of the coil spring 19. According to this arrangement, because a movement in the direction of the side force Fs of the plate 18 with respect to the plunger 12 is allowed, transmission of the side force Fs to the plunger 12 is suppressed.

(2) The position of the joint port 29 is set according to the direction of a side force Fs. A movement in the direction of the side force Fs of the plate 18 with respect to the plunger 12 is thereby allowed. Therefore, transmission of the side force Fs to the plunger 12 can be suppressed without increasing rattling of the plate 18 that causes the generation of noise.

(3) By the projection portion 30 of the plate 18 engaging with the recess portion 28 of the coil spring 19, the coil spring 19 and the plate 18 are restricted from relatively rotating about the central axis L1 of the coil spring 19. Therefore, a shift in the position of the joint port 29 from a regular position in an opposite direction to the direction of a side force Fs as a result of the plate 18 rotating due to vibration or the like generated during operation of the fuel pump can be suppressed. Accordingly, the effect of suppressing transmission of the side force Fs to the plunger 12 can be maintained.

(4) The lifter 20 is restricted from rotating about the central axis L0 of the plunger 12 with respect to the pump body 10. Also, as a result of the projection portion 31 of the lifter 20 engaging with the joint port 29 of the plate 18, a relative rotation about the above-described central axis L0 of the plate 18 and the lifter 20 is also restricted. On the other hand, a pressing force due to compression reaction force of the coil spring 19 acts on contact surfaces of the coil spring 19 and the pump body 10. Therefore, by friction generated between the contact surfaces of the above-described both members, a rotation of the coil spring 19 with respect to the pump body 10 is also restricted. In this case, a relative rotation of the plate 18 with respect to the coil spring 19 is restricted not only from the pump body 10 but also from the lifter 20. Accordingly, a shift in the position of the joint port 29 from a regular position can be further suppressed.

(Second Embodiment)

Next, a second embodiment of a fuel pump of the present invention will be described in detail with reference to FIG. 14 and FIG. 15. In the second embodiment, components in common with those in the first embodiment are designated by the same reference symbols to omit detailed descriptions thereof.

Figure 14:
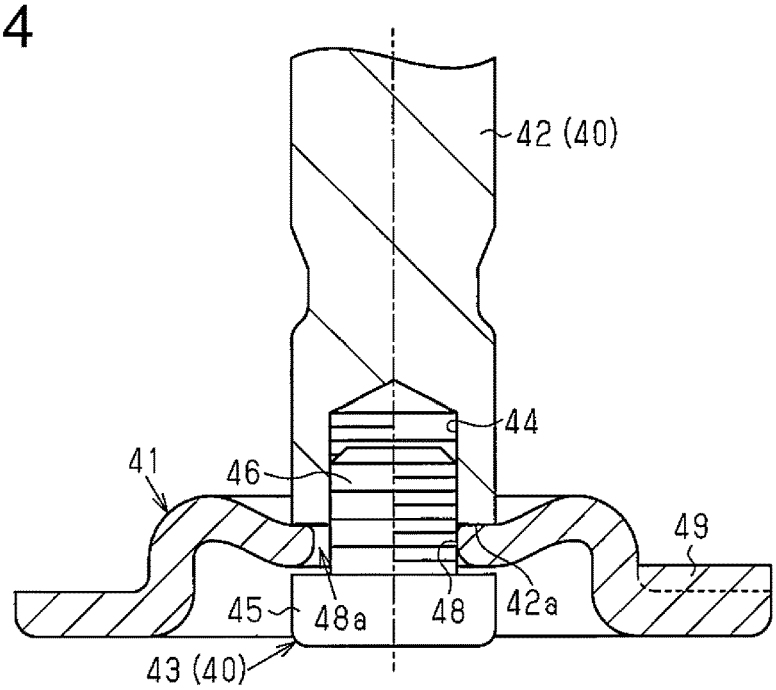
FIG. 14 is a partial sectional view showing the vicinity of a projection end portion of a plunger of a fuel pump according to a second embodiment of the present invention in an enlarged manner.

FIG. 14 shows a part where a plate 41 is attached to a plunger 40 of the fuel pump, in an enlarged manner. As shown in FIG. 14, in a cylinder 11 of a pump body 10, the plunger 40 is located to slide in a reciprocating manner along a central axis L0 of the plunger 40. The plate 41 is attached to a projection-side end portion of the plunger 40. A coil spring 19 is located between the plate 41 and the pump body 10.

The plunger 40 includes a plunger main body portion 42 in a position higher than an engaging position with the plate 41 and a plunger end portion 43 in a position lower than the engaging position with the plate 41. The plunger main body portion 42 is made of a member separate from the plunger end portion 43. A female screw hole 44 extending upward from a lower end surface 42*a* is provided in the plunger main body portion 42. A female screw is formed at an inner peripheral surface of the female screw hole 44. The plunger end portion 43 includes a head portion 45 and a male screw portion 46 projecting upward from the head portion 45. A male screw is formed at an outer peripheral surface of the male screw portion 46. The plate 41 is located between the lower end surface 42*a* of the plunger 42 and the head portion 45. By fastening the male screw portion 46 into the female screw hole 44 in this state, the plate 41 is attached to the plunger 40. In the plunger 40 described above, the part between the end surface 42*a* of the plunger 42 and the head portion 45 functions as a groove 47 engaging with an inner peripheral surface of an engaging hole 48 of the plate 41.

Figure 15:
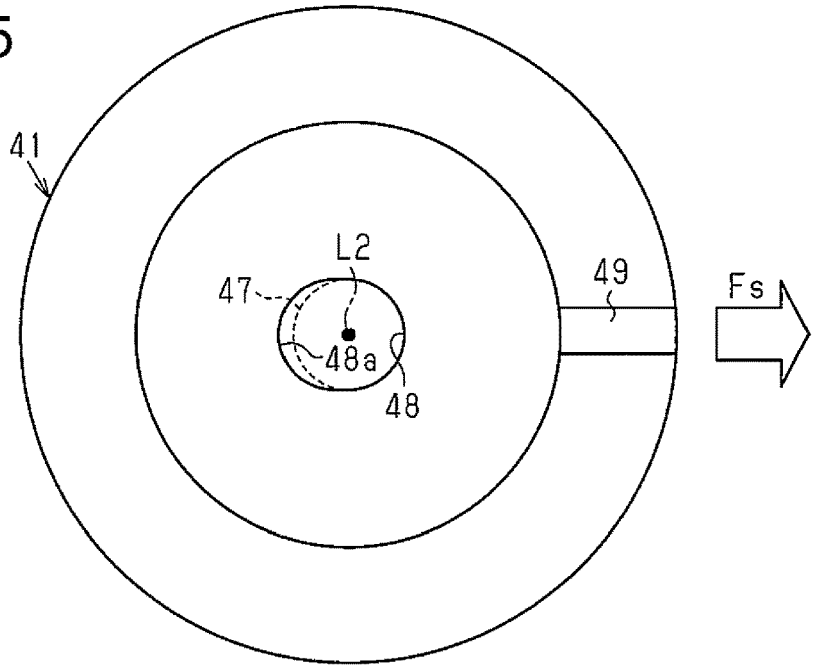
FIG. 15 is a plan view of a plate of the fuel pump.

As shown in FIG. 15, an engaging hole 48 to be engaged with the groove 47 of the plunger 40 is formed in the center of the plate 41. A joint port as described in the first embodiment is not necessary for the plate 41. Therefore, the engaging hole 48 is a closed hole, and does not connect to an outer peripheral surface of the plate 41. Also, a projection portion 49 to be engaged with a recess portion 28 of the coil spring 19 is formed near an outer peripheral edge of the plate 41. The engaging hole 48 is formed, when viewed along a central axis L2 of the plate 41, to be larger at a location that is opposite to the projection portion 49 than at other locations. That is, the engaging hole 48 has an inner radius between the inner peripheral surface of the engaging hole 48 and the central axis L2 that is larger at a location opposite to the projection portion 49 than at other locations. On the other hand, the recess portion 28 of the coil spring 19 is located, when viewed along a central axis L1, at a position aligned with a side force Fs generated during compression of the coil spring 19. The plate 41 is thus assembled in the fuel pump with an increased diameter portion 48*a*, at which the engaging hole 48 is enlarged, located at a position opposite to the direction of a side force Fs.

According to the above-described arrangement, when the central axis L2 of the plate 41 and the central axis L0 of the plunger 40 are coincident, a radial gap between the inner circumferential surface of the engaging hole 48 of the plate 41 and the groove 47 is larger at a position in a counter-side force direction when viewed from the central axis L1 of the coil spring 19 than at a part other than the same. It is thereby allowed that the plate 41 moves in the direction of a side force Fs with respect to the plunger 40 when a side force Fs is generated in the coil spring 19. Therefore, transmission of the side force Fs from the plate 41 to the plunger 40 is suppressed.

Also, the part where the gap between the inner circumferential surface of the engaging hole 48 of the plate 41 and the groove 47 is relatively large is limited, when viewed from the central axis L1 of the coil spring 19, to a position in the counter-side force direction. Therefore, transmission of the side force Fs to the plunger 40 can be suppressed without increasing rattling of the plate 41 that causes the generation of noise.

The above-described respective embodiments may be modified as follows.

In the first embodiment, a relative rotation of the lifter 20 and the plate 18 is restricted by the projection portion 31 of the lifter 20 engaging with the joint port 29 of the plate 18. Instead, a relative rotation of the lifter 20 and the plate 18 may be restricted by engaging a projection portion of the lifter 20 with a recess portion or hole provided in a part other than the joint port 29 of the plate 18. Alternatively, conversely to the above-described arrangement, a projection portion may be provided on the plate 18 and a recess portion may be provided on the lifter 20.

Figure 16:
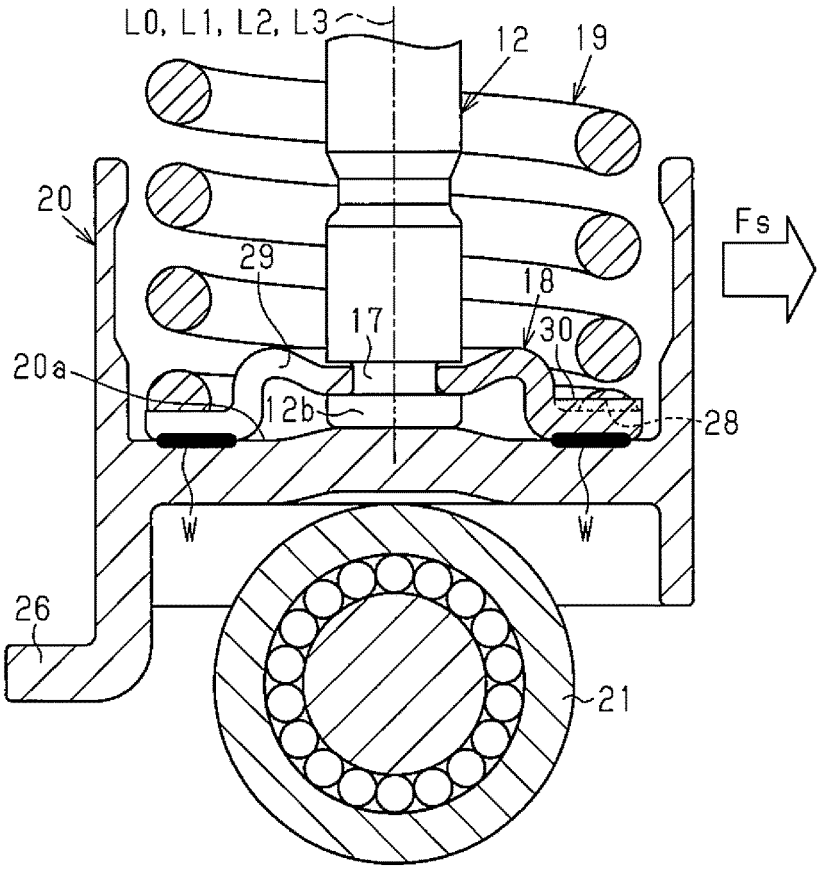
FIG. 16 is a partial sectional view showing the periphery of a lifter of a fuel pump according to a modification.
Figure 17A:
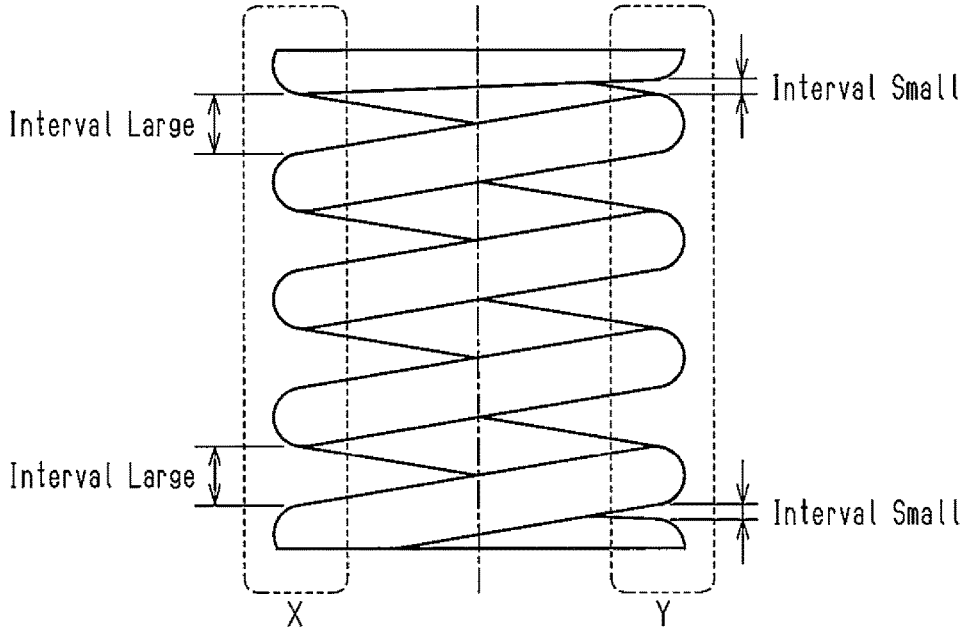
FIG. 17A is a side view of a coil spring at a relaxed position.
Figure 17B:
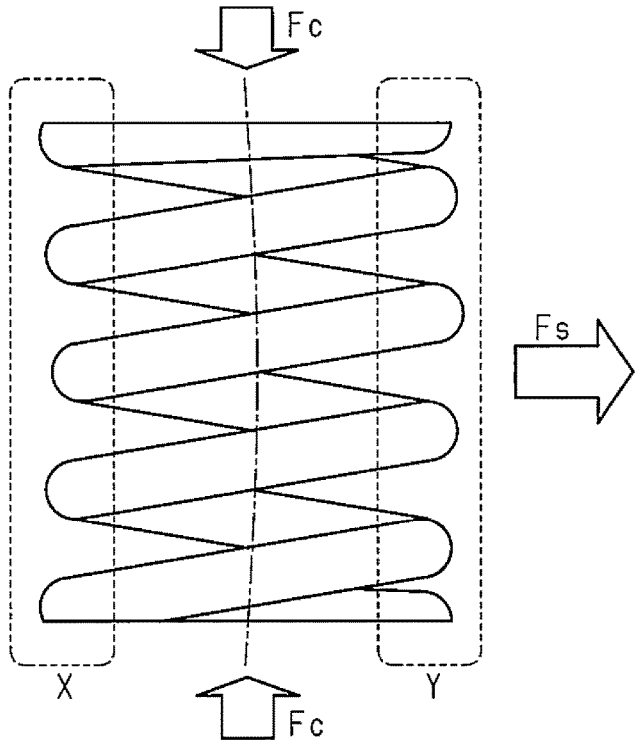
FIG. 17B is a side view of a coil spring under compression.

In the first embodiment, a relative rotation of the plate 18 and the lifter 20 may be restricted using a method other than recess-projection engagement. For example, as shown in FIG. 16, a relative rotation of the lifter 20 and the plate 18 may be restricted by joining the plate 18 to a contact surface W of the inner bottom surface 20*a* of the lifter 20. For example, welding or bonding can join the inner bottom surface 20*a* of the lifter 20 and the plate 18 together.

In the first and second embodiments, the recess portion 28 is formed, in the lower end surface of the coil spring 19 to be brought into contact with the plate 18, 41, at a position in the direction of a side force Fs when viewed from the central axis L1 of the coil spring 19. Also, the projection portions 30 and 49 are formed, in the front surface of the plate 18, 41 to be brought into contact with the coil spring 19, when viewed from the central axis L2 of the plate 18, 41, at a position in a direction opposite to the joint port 29 or the increased diameter portion 48*a* of the engaging hole 48. The position of the recess portion 28 in the circumferential direction of the coil spring 19 and the position of the projection portion 30, 49 in the circumferential direction of the plate 18, 41 may be appropriately changed. However, it is necessary, by engaging the projection portion 30, 49 with the recess portion 28, to restrict a relative rotation of the coil spring 19 and the plate 18, 41 with the joint port 29 or the increased diameter portion 48*a* of the engaging hole 48 located at a position in a counter-side force direction when viewed from the central axis L1 of the coil spring 19. Alternatively, conversely to the above-described arrangement, a projection portion may be provided on the coil spring 19 and a recess portion may be provided on the plate 18, 41.

The recess and projection may be omitted from the coil spring 19 and the plate 18, 41 as long as a relative rotation of the coil spring 19 and the plate 18, 41 can be restricted by friction between contact surfaces of both members generated by pressing due to compression reaction force of the coil spring 19.

The invention claimed is:

1. A fuel pump comprising:

a columnar plunger;

a pump body having a cylinder, one end portion of the plunger being inserted in an interior of the cylinder and another end portion of the plunger projecting externally from the cylinder, the plunger being located inside the cylinder to slide in a reciprocating manner along a central axis of the plunger;

a groove circumferentially extending along an outer surface of the plunger, the groove being formed at the other end portion of the plunger that projects externally from the cylinder;

an annular disk-shaped plate having an inner circumferential surface engaged with the groove;

a cam configured to reciprocate the plunger in the interior of the cylinder;

a lifter located between the one end portion of the plunger and the cam; and a coil spring located between the pump body and the plate, the coil spring pressing the plate towards the lifter, wherein:

a side force that acts in a direction perpendicular to a sliding direction of the plunger is generated in the coil spring during compression of the coil spring;

a direction opposite to the direction of the side force is defined as a counter-side force direction when viewed along a central axis of the coil spring;

the plate includes a joint port that connects an outer peripheral surface of the plate to the inner circumferential surface of the plate, the joint port extending in a direction aligned with the counter-side force when viewed along the central axis of the coil spring; and the lifter has a projection portion located in an interior of the joint port of the plate.

2. The fuel pump according to claim 1, wherein the lifter is restricted from rotating about the central axis of the plunger with respect to the pump body.

3. The fuel pump according to claim 1, further comprising a recess, wherein: the projection and the recess are configured to restrict relative rotation of the plate; and the coil spring is formed on a contact surface where the plate and the coil spring are brought into contact.

4. A fuel pump comprising:

a columnar plunger;

a pump body having a cylinder, one end portion of the plunger being inserted in an interior of the cylinder and another end portion of the cylinder projecting externally from the cylinder, the plunger being located inside the cylinder to slide in a reciprocating manner along a central axis of the plunger;

a groove circumferentially extending along an outer surface of the plunger, the groove being formed at the other end portion of the plunger that projects externally from the cylinder;

an annular disk-shaped plate having an inner circumferential surface engaged with the groove;

a cam configured to reciprocate the plunger in the interior of the cylinder;

a lifter located between the one end portion of the plunger and the cam; and a coil spring located between the pump body and the plate, the coil spring pressing the plate towards the lifter, wherein:

a side force that acts in a direction perpendicular to a sliding direction of the plunger is generated in the coil spring during compression of the coil spring;

a direction opposite to the direction of the side force is defined as a counter-side force direction when viewed along a central axis of the coil spring;

the plate includes, when viewed along the central axis of the coil spring, a radial gap between the inner circumferential surface of the plate and the groove, the radial gap being larger at a location generally aligned with the counter-side force than at other locations when a central axis of the plate and a central axis of the plunger are coincident; and the lifter has a projection portion located in an interior of the radial gap of the plate.

5. The fuel pump according to claim 4, wherein:

the lifter is installed in a state of being restricted from rotating about the central axis of the plunger with respect to the pump body; and the plate is restricted from rotating about the central axis of the plunger with respect to the lifter.

6. The fuel pump according to claim 5, further comprising a recess, wherein: the projection and the recess are configured to restrict relative rotation of the lifter; and the plate is formed on a contact surface where the lifter and the plate are brought into contact.

* * * * *